US007400736B2

(12) United States Patent
Dedieu et al.

(10) Patent No.: US 7,400,736 B2
(45) Date of Patent: Jul. 15, 2008

(54) METHOD FOR EXTENDING THE FREQUENCY RANGE OF A BEAMFORMER WITHOUT SPATIAL ALIASING

(75) Inventors: Stephane Dedieu, Ottawa (CA); Philippe Moquin, Ottawa (CA)

(73) Assignee: Mitel Networks Corporation, Ottawa, Ontario (CA)

( * ) Notice: Subject to any disclaimer, the term of this patent is extended or adjusted under 35 U.S.C. 154(b) by 883 days.

(21) Appl. No.: 10/734,116

(22) Filed: Dec. 15, 2003

(65) Prior Publication Data

US 2004/0120533 A1 Jun. 24, 2004

(30) Foreign Application Priority Data

Dec. 16, 2002 (GB) ..... 0229267.0

(51) Int. Cl.
*H04R 25/00* (2006.01)

(52) U.S. Cl. ..... 381/160; 381/92; 381/91

(58) Field of Classification Search ..... 381/92, 381/356, 160, 91, 122, 98, 103; 367/61, 367/119, 138
See application file for complete search history.

(56) References Cited

U.S. PATENT DOCUMENTS 5,592,441 A * 1/1997 Kuhn ..... 367/153
5,742,693 A * 4/1998 Elko ..... 381/92
6,041,127 A 3/2000 Elko
6,681,023 B1 * 1/2004 Turnbull et al. ..... 381/369
7,068,801 B1 * 6/2006 Stinson et al. ..... 381/160
7,269,263 B2 * 9/2007 Dedieu et al. ..... 381/92

FOREIGN PATENT DOCUMENTS

CA 2292357 8/2000

OTHER PUBLICATIONS

Jens Meyer, "Beamforming for a Circular Microphone Array Mounted on Spherically Shaped Objects", Journal of the Acoustical Society of America, 109(1), Jan. 2001, pp. 185-193.
J. Meyer et al, "A Highly Scalable Spherical Microphone Array Based on an Orthonormal Decomposition of the Soundfield", Proc. IEEE Int. Conf. Acoustics, Speech & Signal Processing, 2002 (ICASSP'02), May 2002, vol. 2, pp. 1781-1784.
Brandstein et al, Microphone Arrays Signal Processing Techniques and Applications, Springer 2001, ISBN 3-540-41953-5 Springer-Verlag Berlin Heidelberg New York 2001, Printed in Germany, pp. 20-38.
Marc Anciant, "Modélisation du Champ Acoustique Incident au Décollage de la Fusée Ariane", Jul. 1996, Ph.D. Thesis, Université de Technologie de Compiégne, France, Chapter 2, pp. 18-45.

(Continued)

*Primary Examiner*—Vivian Chin
*Assistant Examiner*—Jason R Kurr
(74) *Attorney, Agent, or Firm*—Michelle Whittington, Esq.

(57) ABSTRACT

A conferencing unit, comprising an array of microphones embedded in a diffracting object configured to provide a desired high frequency directivity response at predetermined microphone positions, and a low frequency beamformer operable to achieve a desired low frequency directivity response, wherein the beamformer is linearly constrained to provide a smooth transition between low and high frequency directivity responses.

11 Claims, 17 Drawing Sheets

OTHER PUBLICATIONS

A.C.C. Warnok et al , "Voice and Background Noise Levels Measured in Open Offices", IRC Internal Report IR-837, Jan. 2002, appearing in Review of Acoustical Properties of Human Speakers, pp. 1-20.

Philip M. Morse et al, Theoretical Acoustics, Princeton University Press, 1968, Chapter 7.2, pp. vii and 332-334.

* cited by examiner

Directivity measured for male talkers for the 250 and 1000Hz octave bands.

Figure 10 (1)
| Method | Super directive method | Constrained Super directive method |
| --- | --- | --- |
| Frequency | 300 Hz | |
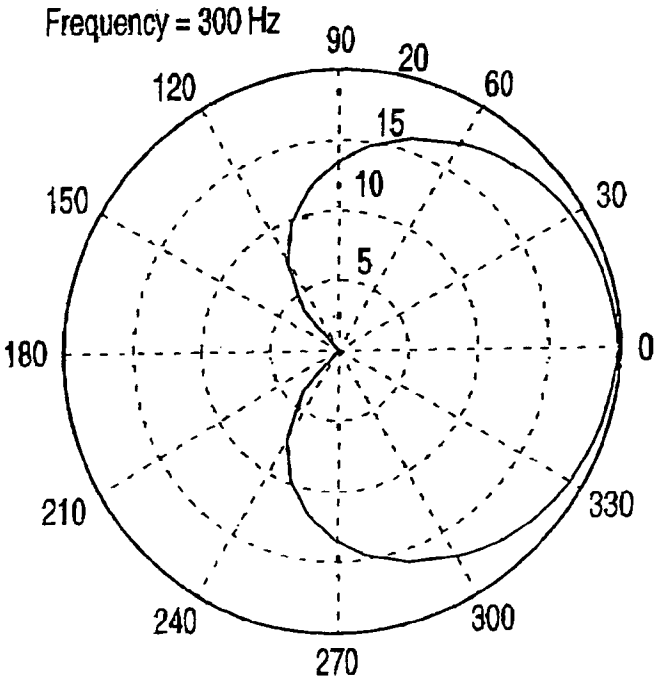
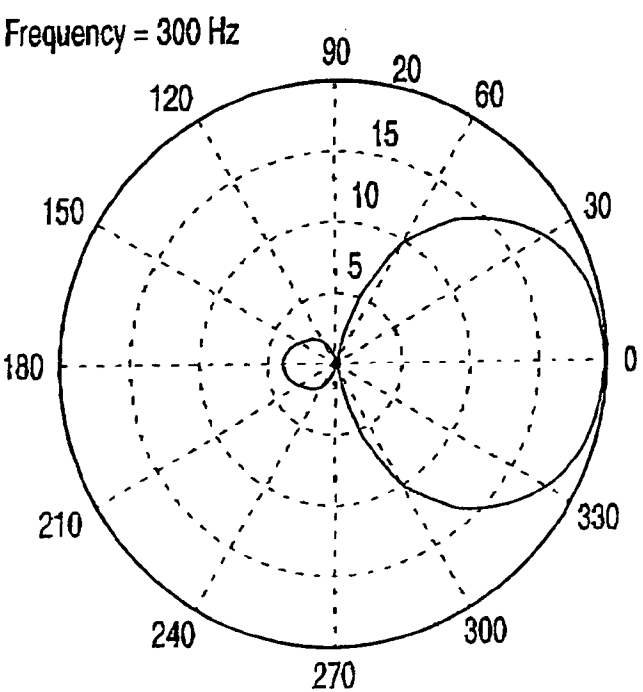

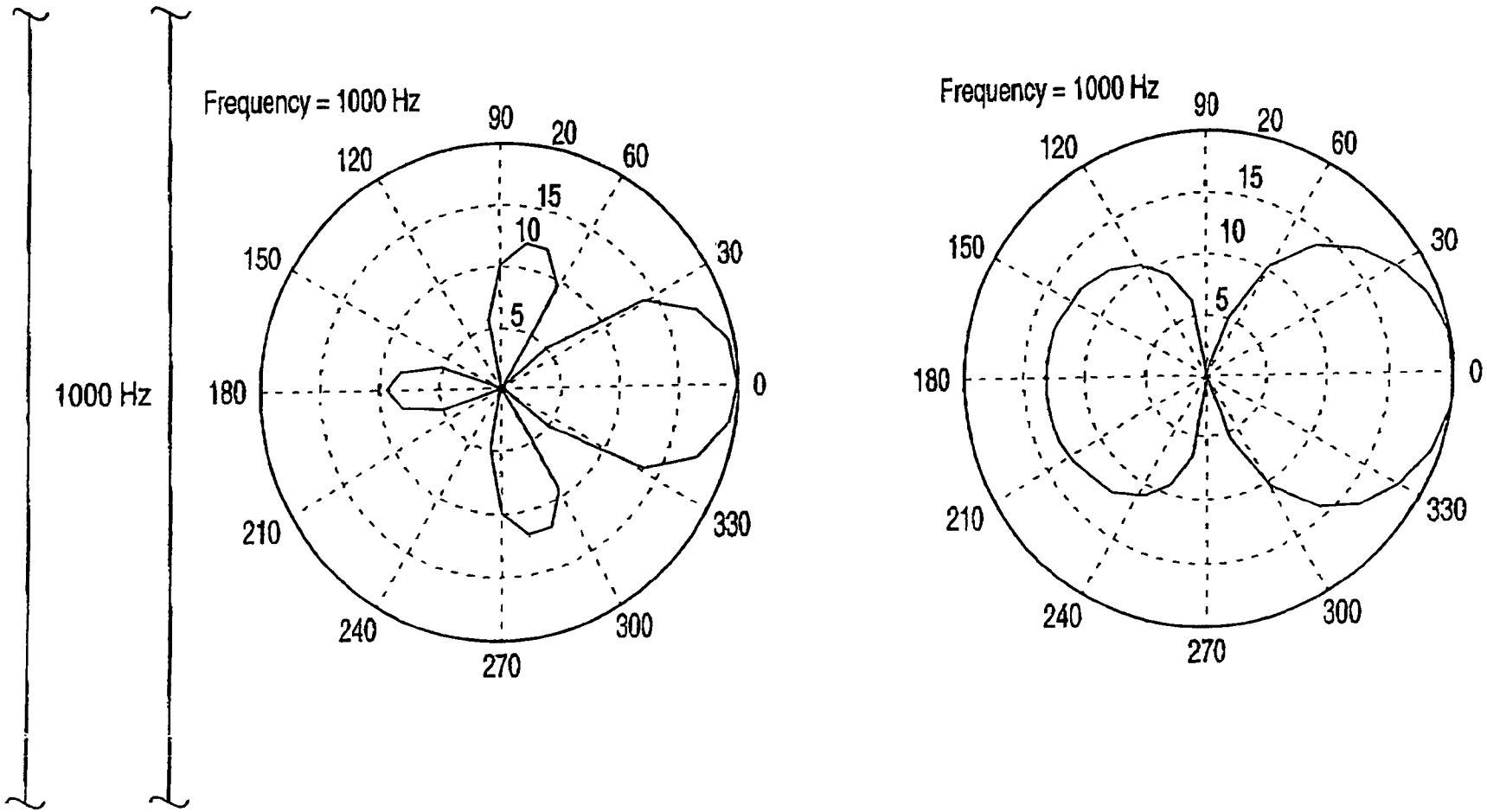
Figure 10 (2)

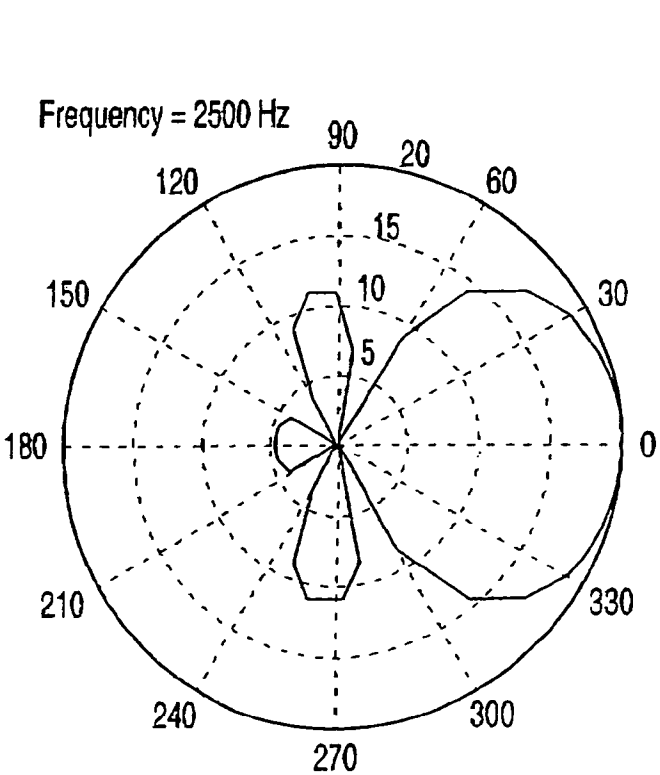
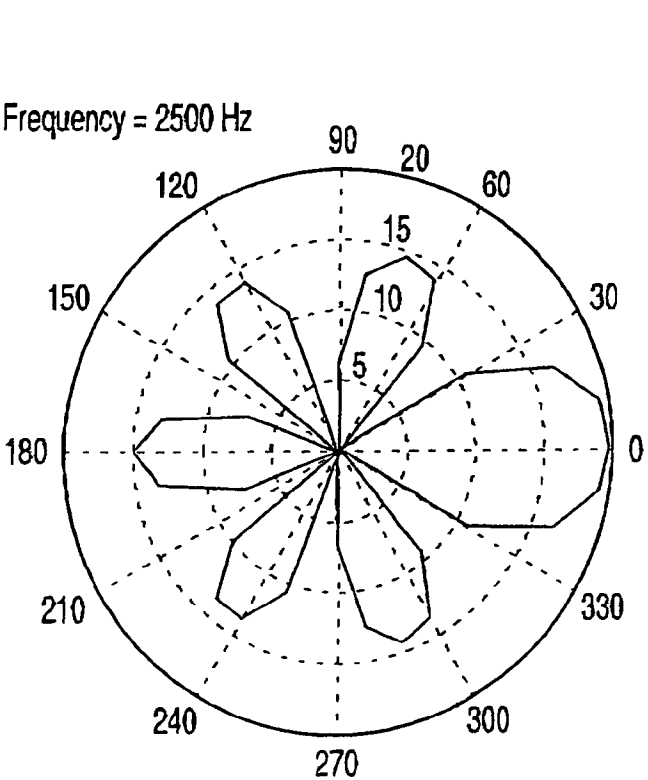
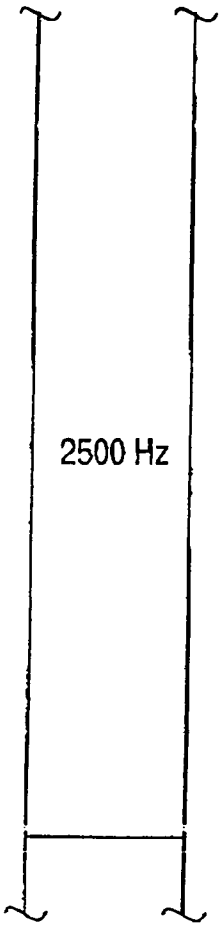
Figure 10 (3)

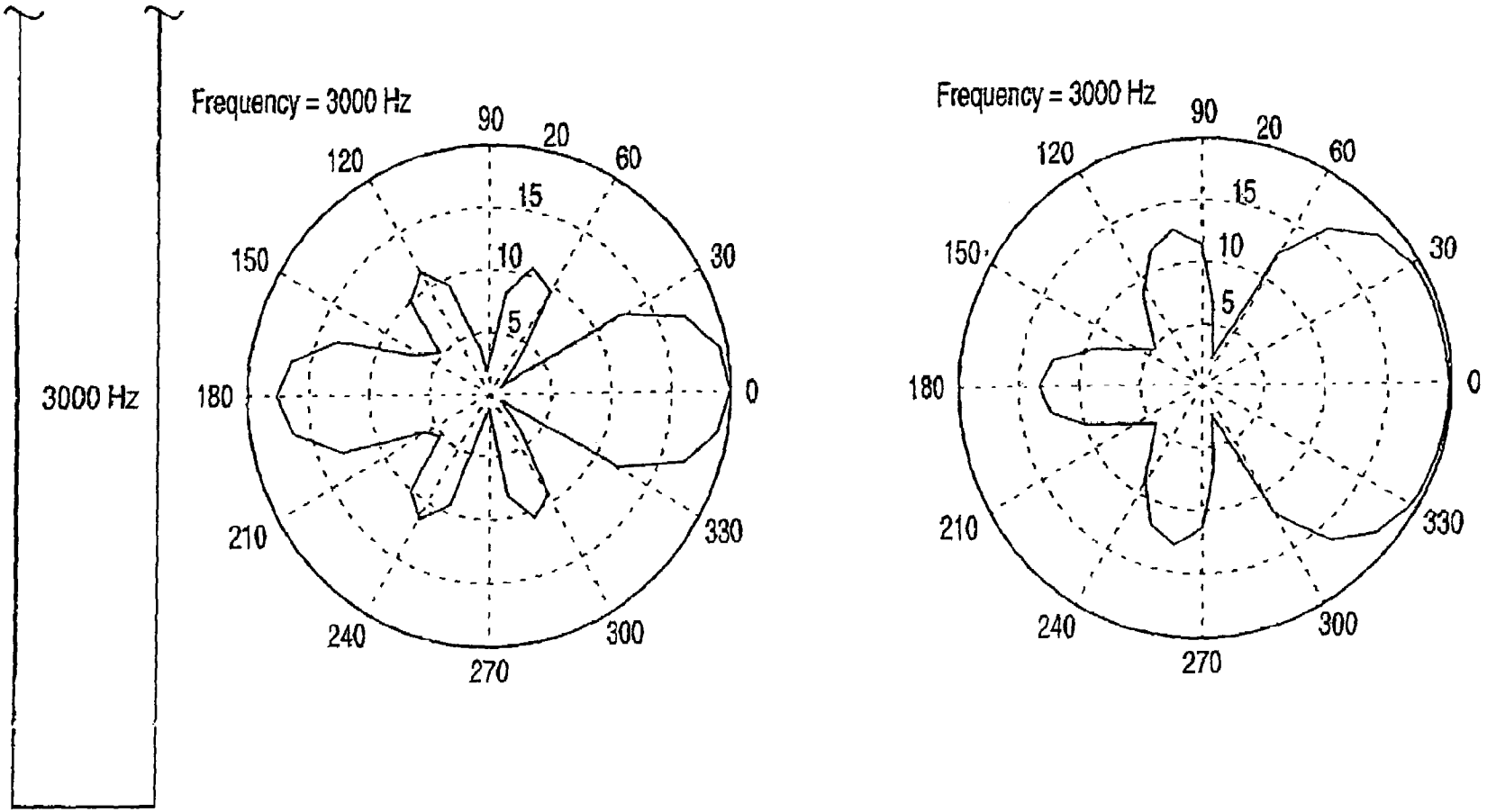
Figure 10 (4)

Figure 10 (5)
| Method | Microphone alone + Acoustic absorbent |
|---|---|
| Frequency | |
| 4000 Hz | 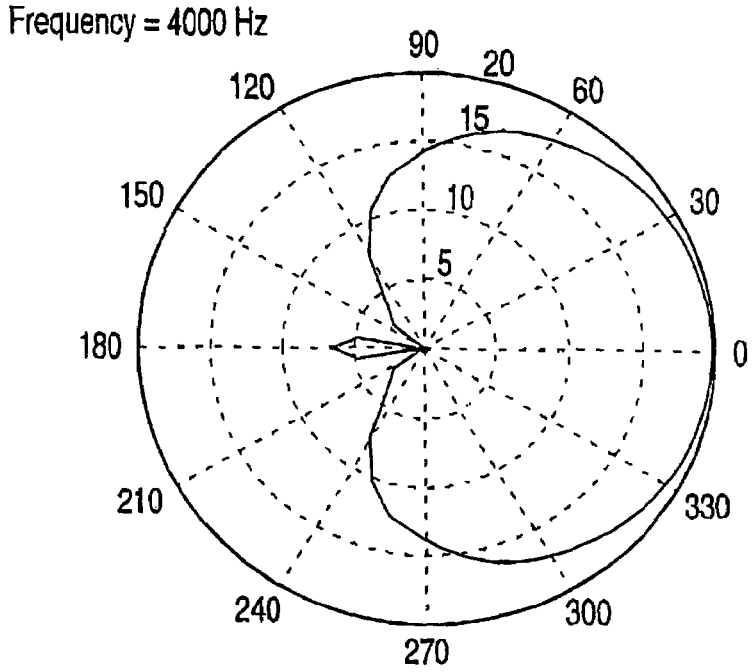 |
| 5000 Hz | 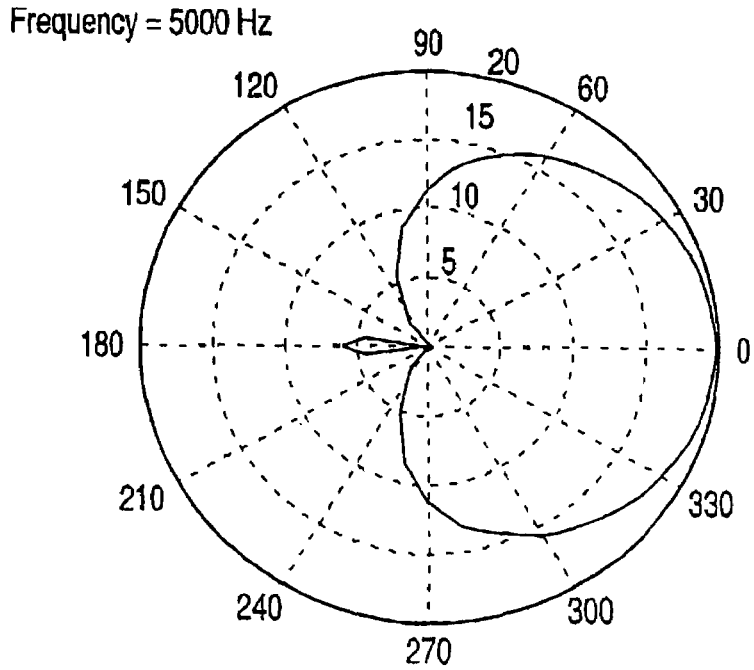 |

Figure 10 (6)
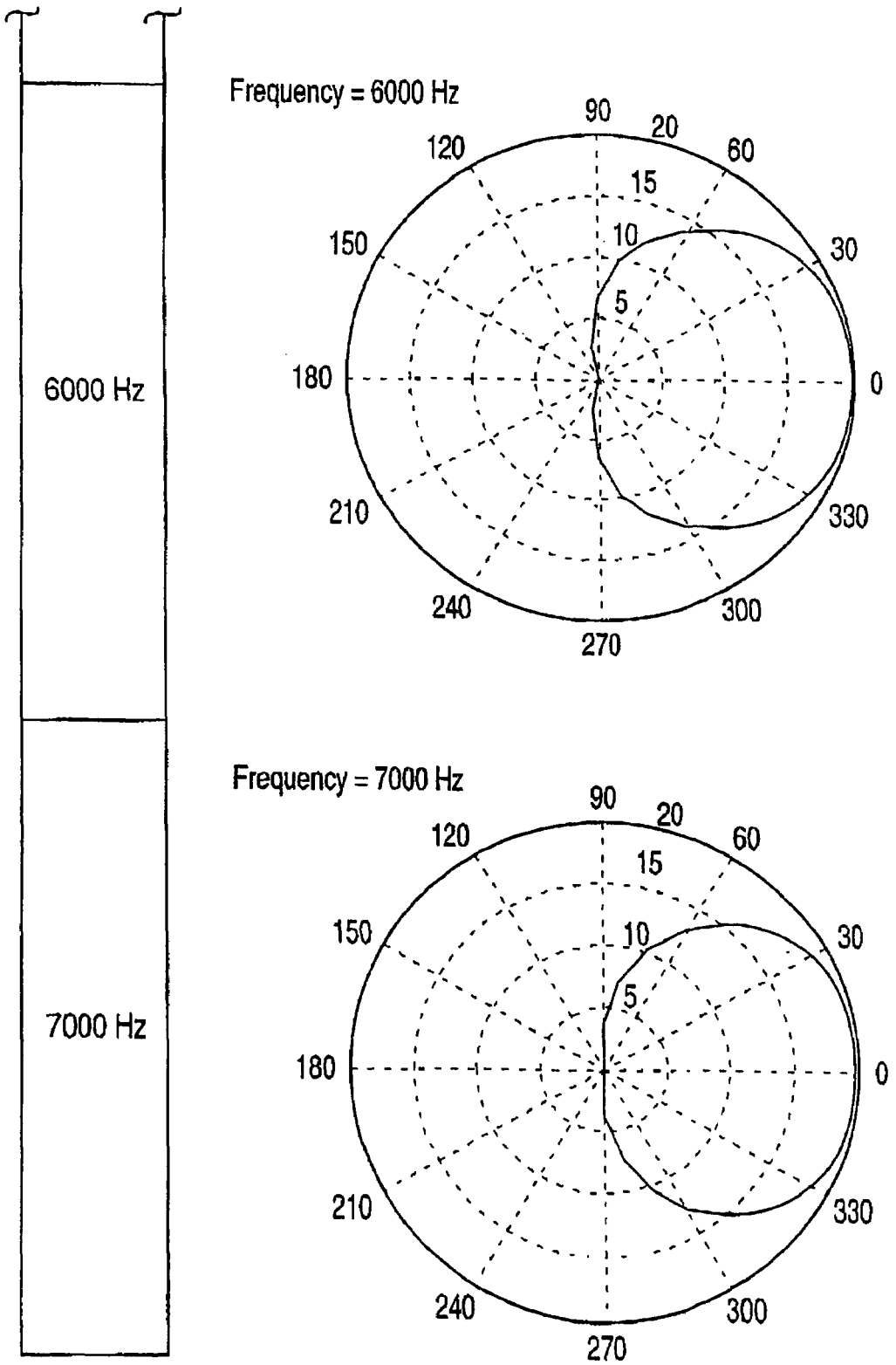

METHOD FOR EXTENDING THE FREQUENCY RANGE OF A BEAMFORMER WITHOUT SPATIAL ALIASING

FIELD OF THE INVENTION

The present invention relates in general to microphone arrays, and more particularly to a microphone array incorporating an obstacle and an absorbing material to achieve high directivity at frequencies for which the distance between microphones is greater than half the acoustic wavelength (grating lobes).

BACKGROUND OF THE INVENTION

Directional microphones are well known for use in speech systems to minimise the effects of ambient noise and reverberation. It is also known to use multiple microphones when there is more than one talker, where the microphones are either placed near to the source or more centrally as an array. Moreover, systems are also known for determining which microphone or combination to use (i.e. higher noise and reverberation requires that an increased number of directional microphones be used). In teleconferencing situations, it is known to use arrays of directional microphones associated with an automatic mixer. The limitation of these systems is that they are either characterised by a fairly modest directionality or they are of costly construction.

Microphone arrays have been proposed to solve the foregoing problems. They are generally designed as free-field devices and in some instances are embedded within a structure. The limitation of prior art microphone arrays is that the inter-microphone spacing is restricted to half of the shortest wavelength (highest frequency) of interest. This means that for an increase in frequency range, the array must be made smaller (thereby losing low frequency directivity) or microphones must be added (thereby increasing cost). The other problem with this approach is that the beamwidth decreases with increasing frequency and side lobes become more problematic. This results in significant off axis "coloration" of the signals. As it is impossible to predict when a talker will speak, there is necessarily a time during which the talker will be off axis and this "coloration" will degrade the signal.

It is an object of this invention to provide a microphone array having a reasonably constant beampattern over a frequency range that extends beyond the traditional limitation of inter-sensor spacing to half a wavelength.

The following references illustrate the known state of the art:

[1] Michael Brandstein, Darren. Ward, "Microphone arrays", Springer, 2001.

[2] Gary Elko, "A steerable and variable first-order differential microphone array", U.S. Pat. No. 6,041,127, Mar. 21, 2000.

[3] Michael Stinson, James Ryan, "Microphone array diffracting structure", Canadian Patent Application 2,292,357.

[4] Jens Meyer, "*Beamforming for a circular microphone array mounted on spherically shaped objects*", Journal of the Acoustical Society of America 109 (1), January 2001, pp. 185-193.

[5] Marc Anciant, "*Modélisation du champ acoustique incident au décollage de la fusée Ariane*", July 1996, Ph.D. Thesis, Université de Technologie de Compiègne, France.

[6] A. C. C. Warnock & W. T. Chu, "Voice and Background noise levels measured in open offices", IRC Internal Report IR-837, January 2002.

[7] S. Dedieu, P. Moquin, "Method for Broadband Constant Directivity Beamforming for Non Linear and Non Axi-Symmetric Arrays Embedded in an Obstacle", U.S. Patent Application Publication No. 2004/0120532.

[8] Morse and Ingard, "Theoretical Acoustics", Princeton University Press, 1968.

Brandstein and Ward [1] provide a good overview of the state of the art in free-field arrays. Most of the work in arrays has been done in free field, where the size of the array is necessarily governed by the frequency span of interest.

The use of an obstacle in a microphone array is discussed in Elko [2]. Specifically, Elko uses a small sphere with microphone dipoles in order to increase wave-travelling time from one microphone to another and thus achieve better performance in terms of directivity. A sphere is used since it permits analytical expressions of the pressure field generated by the source and diffracted by the obstacle. The computation of the pressure at various points on the sphere allows the computation of each of the microphone signal weights. The spacing limit is given as $2\lambda/\pi$ (approx. $0.64\lambda$) where $\lambda$ is the shortest wavelength of interest.

M. Stinson and J. Ryan [3] extend the principle of microphone arrays embedded in obstacles to more complex shapes using a super-directive approach and a Boundary Element method to compute the pressure field diffracted by the obstacle. Stinson and Ryan emphasise low frequency, trying to achieve strong directivity with a small obstacle and a specific treatment using cells (i.e. reactive impedance) thereby inducing air-coupled surface waves. This results in an increase in the wave travel time from one microphone to another and increases the "apparent" size of the obstacle for better directivity at low frequencies. Stinson and Ryan have proven that using an obstacle provides correct directivity in the low frequency domain, when generally other authors use microphone arrays of large size. Additionally Stinson and Ryan invoke the use of acoustic absorbent materials to provide impedance treatment. However, the application is designed for narrow band telephony.

The benefit of an obstacle for a microphone array in terms of directivity and localisation of the source or multiple sources is also described in the literature by Jens Meyer [4] and by Marc Anciant [5]. Jens Meyer demonstrates the benefit of adding a sphere on a microphone array compared to a free-field array in terms of broadband performance and noise rejection. Anciant describes the "shadow" area for a 3D-microphone array around a mock-up of the Ariane IV rocket in detecting and characterising the engine noise sources at take-off.

With the exception of Elko [2] (who sets the spacing limit at $2\lambda/\pi$), the prior art explicitly or implicitly concedes the requirement for a high frequency performance limit defined by an inter-element spacing of $\lambda/2$ to avoid grating lobes in free-field.

The superdirective beamformers that are commonly used for microphones are discussed in chapter 2 of Brandstein [1] and the essential elements are noted below, to better understand the background of the present invention.

Beamforming may be used to discriminate a source position in a "noisy" environment at a frequency $\omega$ in a band $[\omega_0, \omega_n]$. Let $d(\omega)$ be the signal vector containing the signal $d_i(\omega)$ of each microphone of the array when the source is active. Let $n(\omega)$ be the vector of noise signal at each microphone and $R_{nn}(\omega)$ the noise correlation matrix. Depending on the environment, this matrix can be defined in different ways, such as for diffuse spherical or cylindrical isotropic noise or more simply for white noise. Reference [5] provides a detailed discussion of how the noise correlation matrix may be defined.

Beamforming consists of finding a vector $w_{opt}(\omega)$ of coefficients $w_i(\omega)$ such that weighting the signal $d_i(\omega)$ at each microphone with each $w_i(\omega)$ creates a beam towards the source. For a super directive approach, the problem can be written in the following way:

$$\mathrm{Min}_w \frac{1}{2} w^H R_{nn} w \quad \text{subject to} \quad w^H d = 1 \tag{1}$$

where the dependency in ω has been omitted for clarity purposes.

The optimal weight vector is:

$$w_{opt} = \frac{R_{nn}^{-1} d}{d^H R_{nn}^{-1} d} \tag{2}$$

As described in U.S. Patent Application Publication No. 2004/0120532, linear or quadratic constraints can be added to impose a specific pattern to a beam, to reduce the coupling between the microphone beam and a loudspeaker or to keep the beam constant vs. frequency or vs. angle when the obstacle is not axi-symmetric.

SUMMARY OF THE INVENTION

According to the present invention, a method of spatial filtering of a microphone array is provided in which the distance between microphones (or sensors) is greater than λ/2 (where λ=acoustic wavelength).

More particularly, a plurality of microphones is embedded in a diffraction structure that provides the desired directivity at high frequencies. In one embodiment, acoustically absorptive materials are used on the object. To provide the desired directionality at lower frequencies, beamforming of the microphones is performed using digital signal processing techniques. The combination of beamforming and embedding the microphones in a diffraction structure that provides the desired directivity at high frequencies addresses the two weaknesses that arise in prior art approaches: low frequency directivity with small structures and high frequency difficulties that arise in conventional sensor arrays.

One advantage of the invention is the extension of the working frequency range for an existing narrow-band telephony microphone array to wide-band telephony (up to 7 kHz), without modifying its geometry and the number of microphones. The invention effectively extends the working frequency range of a microphone array beyond its "limit" frequency, which depends on the inter-microphone distance. The invention operates at frequencies where beamforming is possible with only one or two microphones. Thus, the invention is operable with omnidirectional microphones, resulting in cost reduction and the ability to use inexpensive DSPs.

BRIEF DESCRIPTION OF THE DRAWINGS

A detailed description of the invention is provided herein below, with reference to the following drawings, in which:

FIG. 10 shows the beampattern of the microphone array of the present invention at various frequencies.

DETAILED DESCRIPTION OF THE PREFERRED EMBODIMENT

To illustrate the principles of the invention a conventional spherical shape is set forth for the array of embedded microphones. However, the concepts as applied to this simple shape (a sphere) may be extended to more complicated shapes, as will be readily understood by a person of ordinary skill in the art.

Firstly, an enclosure is provided for the microphones that acts as a diffracting object to provide the desired high frequency response. In order to reduce costs, omnidirectional electret microphones are used. This also simplifies the design as it assumed that the microphones simply sample the pressure field at the surface of the diffracting object and that the microphones are rigid. Secondly, these microphones are combined into an array to achieve the low frequency response required, as discussed in greater detail below. Thirdly, a transition area is established where the system reverts from microphone array operation to selecting a single microphone.

Figure 1:
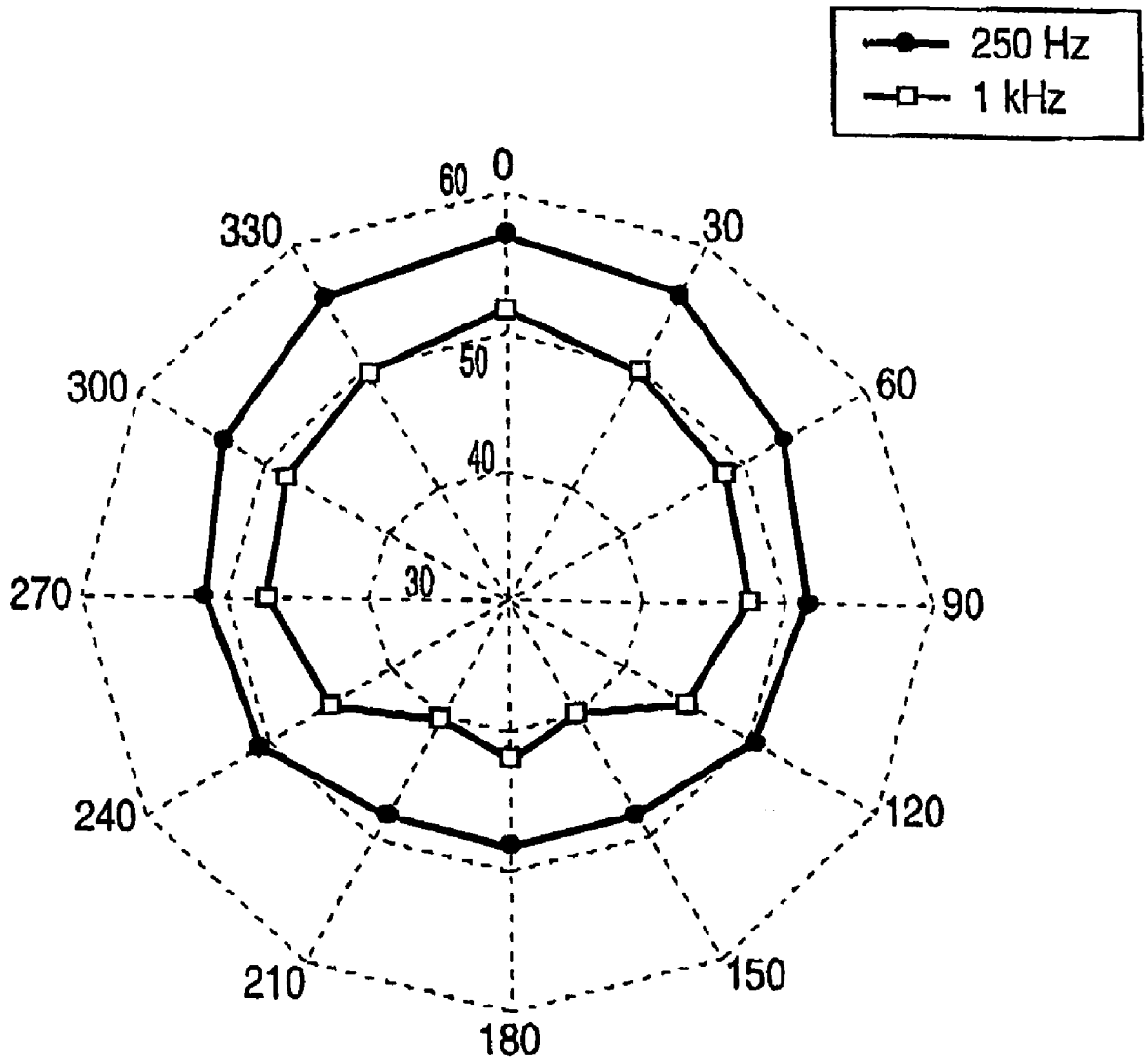
FIG. 1 is a plot of mouth directivity as is known from the prior art.

In order to simplify the acoustical modelling, it will be assumed that the source of interest is an acoustical monopole. As the primary application of the invention is speech (i.e. conferencing) one must consider the directionality of the human voice. Recent measurements by Warnock [6] are illustrated in FIG. 1. It will be observed that within a 90-degree sector in front of a talker the human voice can be modelled as an acoustic monopole. It will also be noted that as the frequency increases the directivity of the voice increases so that directivity of the microphone system is not as necessary for high frequencies.

A Spherical Baffle

Figure 2:
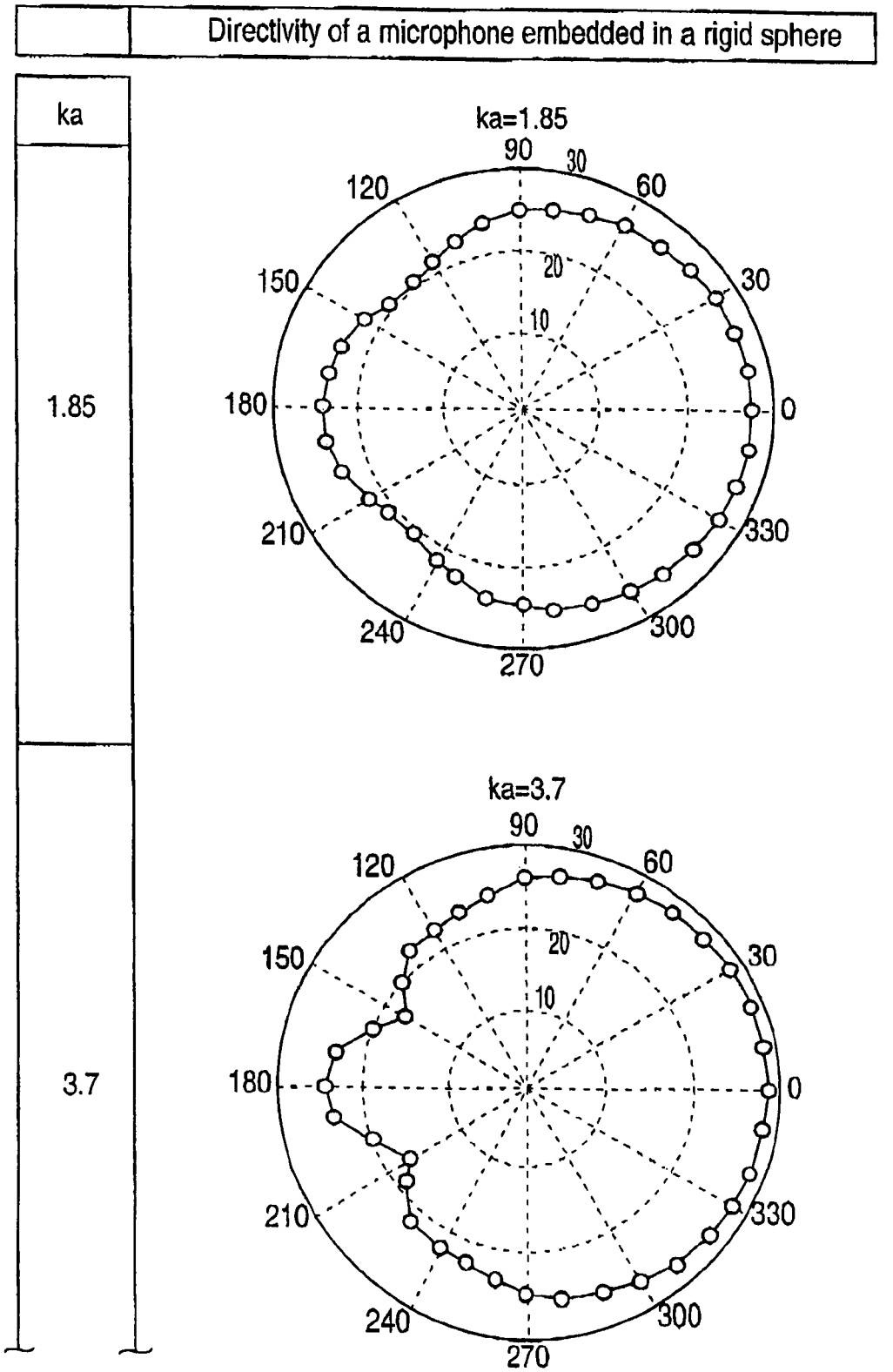
FIG. 2 is a plot of directivity for a single microphone on the surface of a hard diffracting sphere.
Figure 2:
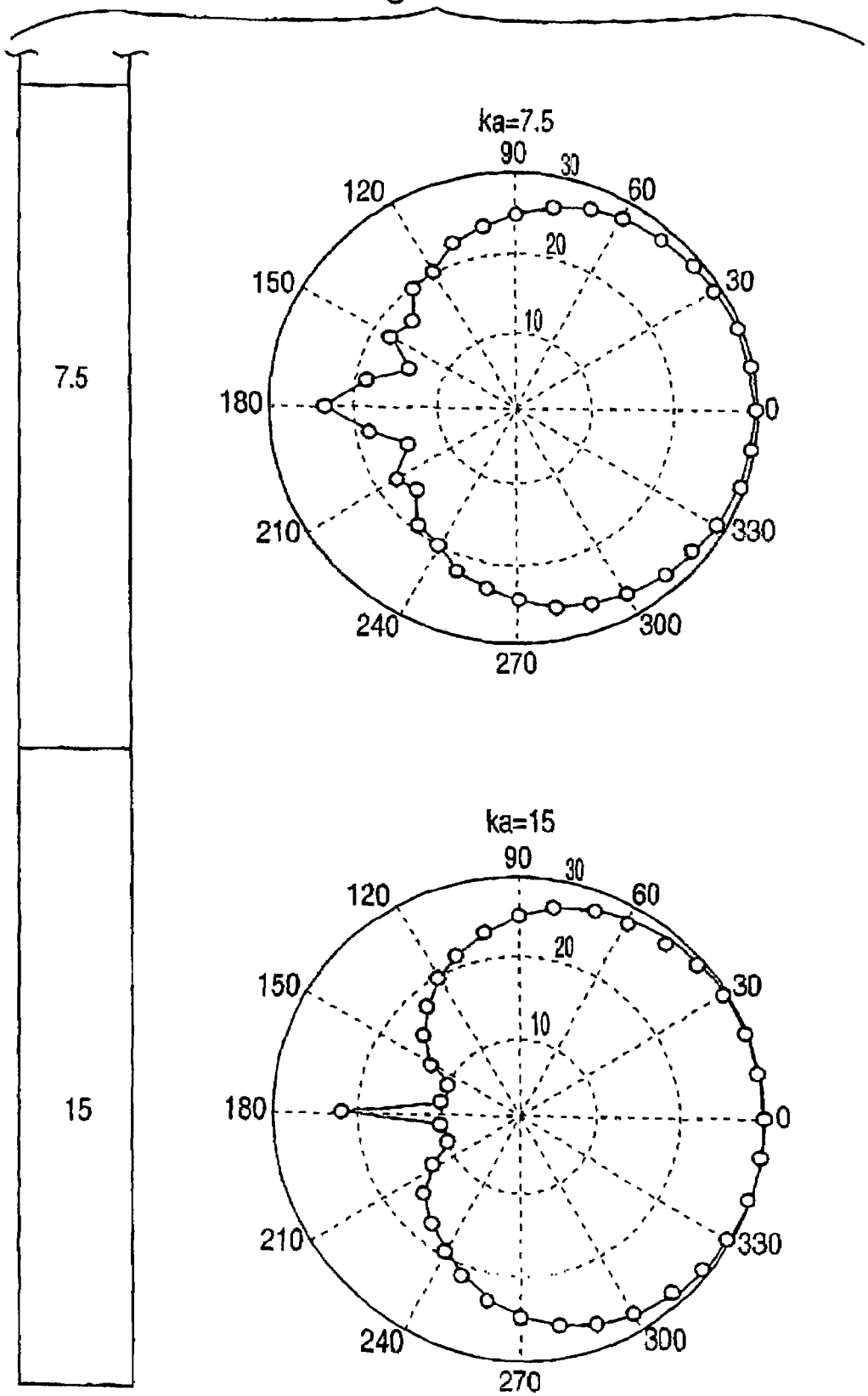

An analytical solution to the problem of a hard sphere is provided in Morse [8] (equation 7.2.18). An alternate solution is found in Meyer [4]. Considering the pressure field from a plane wave impinging upon the sphere from various directions, the pressure at a point on the sphere indicates the directionality. Naturally, the solution scales with the size of the object and the frequency. As illustrated in FIG. 2, no significant directionality occurs at frequencies below approximately $ka<2$ where $k=2\pi f/c$ (f=frequency, c=speed of sound) and a is the radius of the sphere.

At lower frequencies (up to D=λ/2 where D is the inter-element spacing) multiple microphones may be disposed on the sphere as suggested by Meyer [4] or Elko [2], thereby extending Meyer's 0.2 m diameter spherical array to cover up to 20 kHz.

There remains a transition area between the low frequencies where the beamformer works well and the higher frequencies, which offer increased directionality. The method proposed herein uses a constrained super-directive approach as disclosed in UK Patent Application No. 8061-734. By using two symmetrical look direction vectors $d_{\theta-\alpha}$ and $d_{\theta+\alpha}$ with a gain constraint less than one (e.g. 0.707), a beam that is wider than the superdirective method is produced, but which is narrower than that provided by simply using a diffracting object. The spacing of the two directions ($\theta-\alpha$ and $\theta+\alpha$) increases with frequency. Eventually, the frequency weights degenerate to $w_{opt}$=<1,0,0,0,0,0> for a six-element array at $\theta=0$. One skilled in the art of acoustics will be able to determine the required variation in $\alpha$ with frequency, as it is dependent on the obstacle geometry.

The application of analytical equations to the simple shape of a sphere may be extended to other simple shapes (e.g. cylinders). Moreover, the same principles may be applied to more complex shapes, that are closer to a realistic product.

An Inverted Truncated Cone Upon a Reflecting Plane

Figure 3:
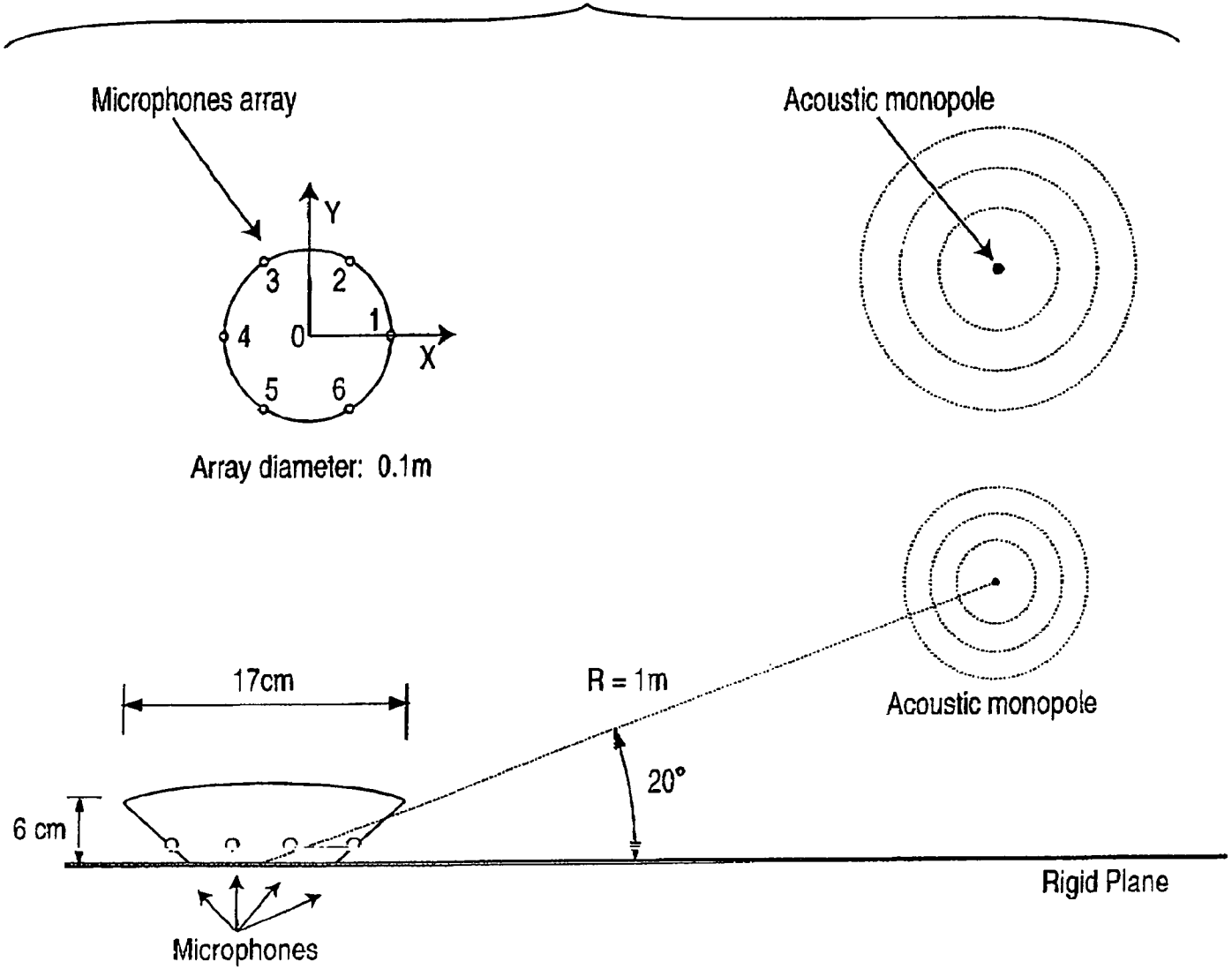
FIG. 3 is a schematic illustration of the microphone array and a point sound source, according to the preferred embodiment of the invention.
Figure 4:
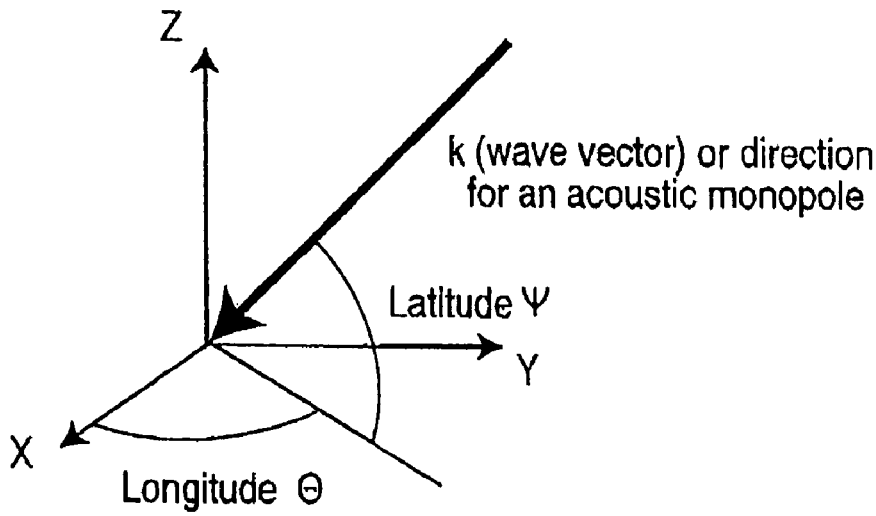
FIG. 4 shows the three dimensional co-ordinates used in describing operation of the microphone array of FIG. 3.

The Mitel 35xx conference unit conforms essentially to the shape of an inverted truncated cone, as illustrated in FIG. 3. The size of the obstacle (i.e. housing of the conference unit) is constrained by industrial design considerations. The number of microphones is optimised to six so that the distance between microphones is 5 cm., thereby providing alias-free spatial sampling in the traditional telephony frequency band (i.e.300-3400 Hz). FIG. 4 illustrates the spatial co-ordinates used (spherical co-ordinates where $\theta$ is the x-y plane and $\psi$ is the angle between the z direction and the x-y plane). It will be appreciated that illustrated geometry does not allow an easy analytical solution and that numerical methods must be used.

Figure 5:
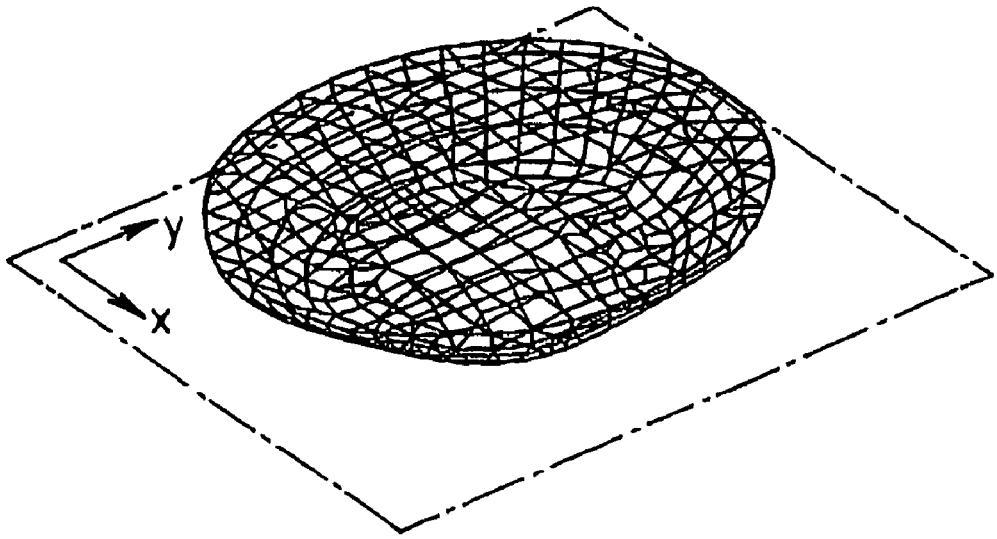
FIG. 5 is a BE mesh model of the microphone array of FIG. 3.

Assuming a perfectly rigid obstacle, the Boundary Element Method may be used to create the model of FIG. 5, which accounts for a rigid plane and impedance conditions on the surface when an absorbing material is used. The typical source is an acoustic monopole at ($r=1$ m, $\theta=0$ deg, $\psi=20$ deg) with an amplitude of $1N/m^2$. Solution of the problem using the Boundary Element Method gives the total pressure field on the obstacle: the sum of the incident and diffracted fields.

Figure 6:
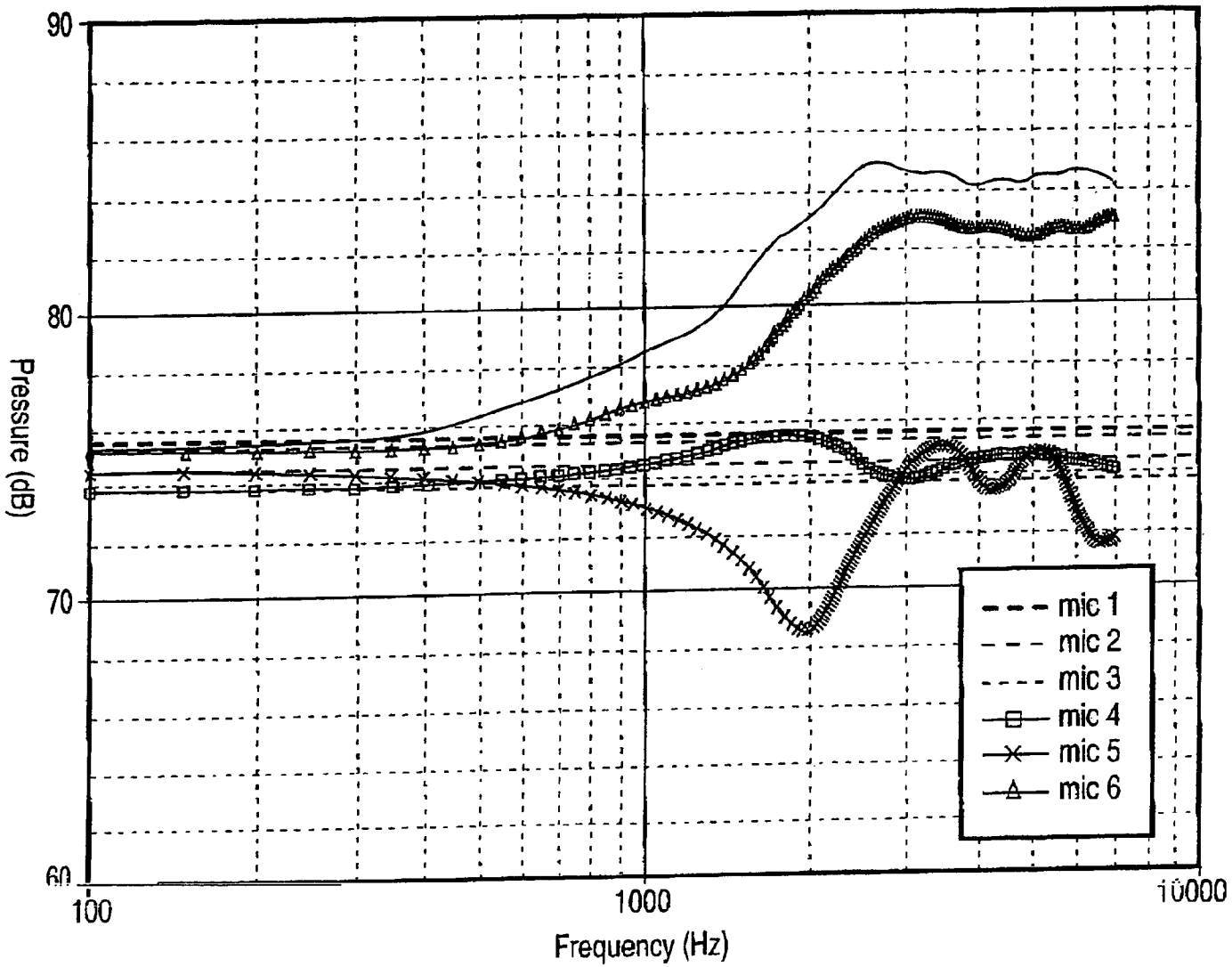
FIG. 6 is a plot of acoustic pressures for the microphone array of FIG. 3.

It will be noted from FIG. 6 that as compared to free-field conditions, the wave travel time from one microphone to another is increased, as has been described in [2] and [3]. Secondly, the pressure magnitude at the microphones facing the source is enhanced compared to the microphones in the opposite direction, in this case by about 8 dB.

Thus, a small obstacle of about 10 cm diameter provides a shadow effect resulting in an increase of the attenuation starting close to 400 Hz and reaching a maximum of 9 dB at about 2.5 kHz for microphones in the source opposite direction (microphones 3,4,5 in FIGS. 3 and 6). This is contrasted with only a 2 dB difference in free field in the presence of a rigid plane (dotted lines in FIG. 6). It will also be noted that due to symmetry, the curves for microphones 5 and 6 overlap the curves for microphones 3 and 2, respectively.

Figure 7:
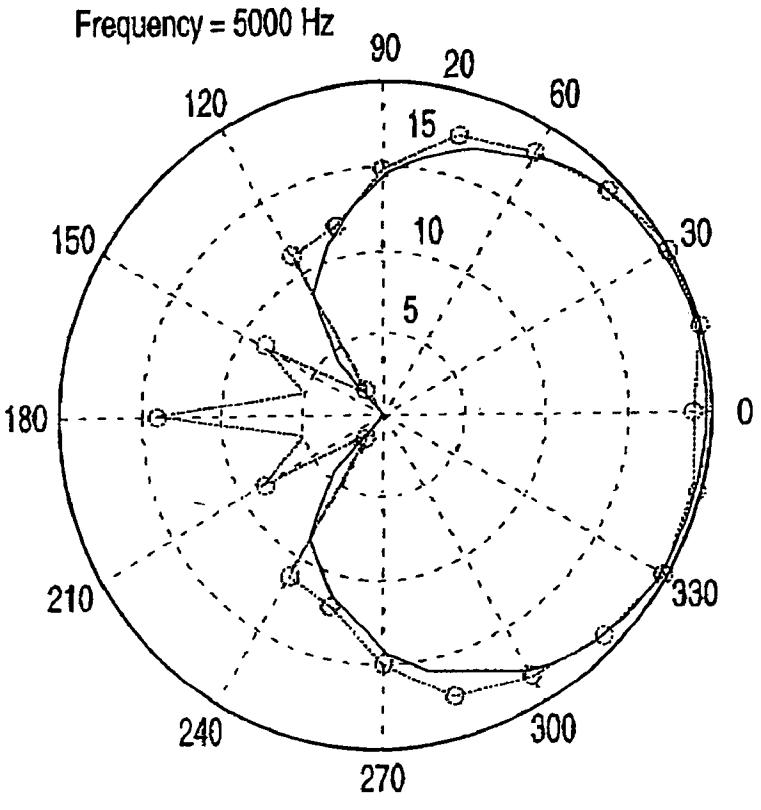
FIG. 7 is a plot of directivity for a single microphone in the array of FIG. 2.
Figure 7:
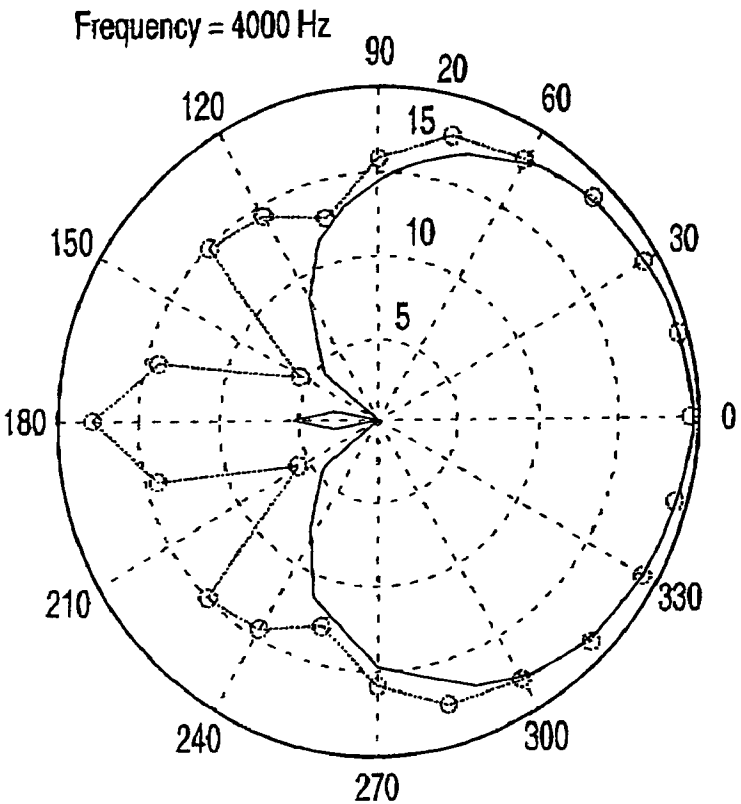
Figure 7:
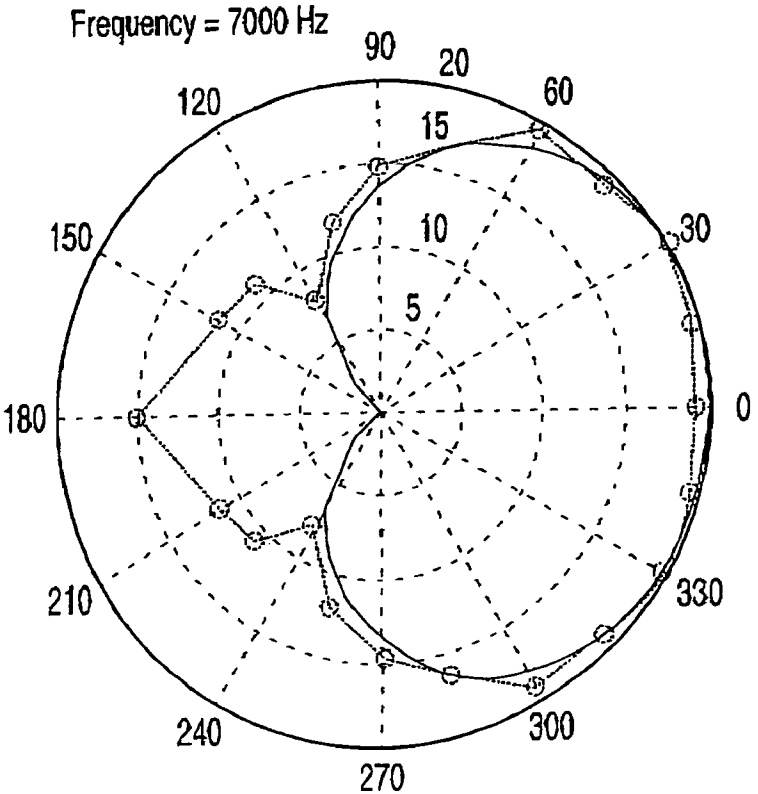
Figure 7:
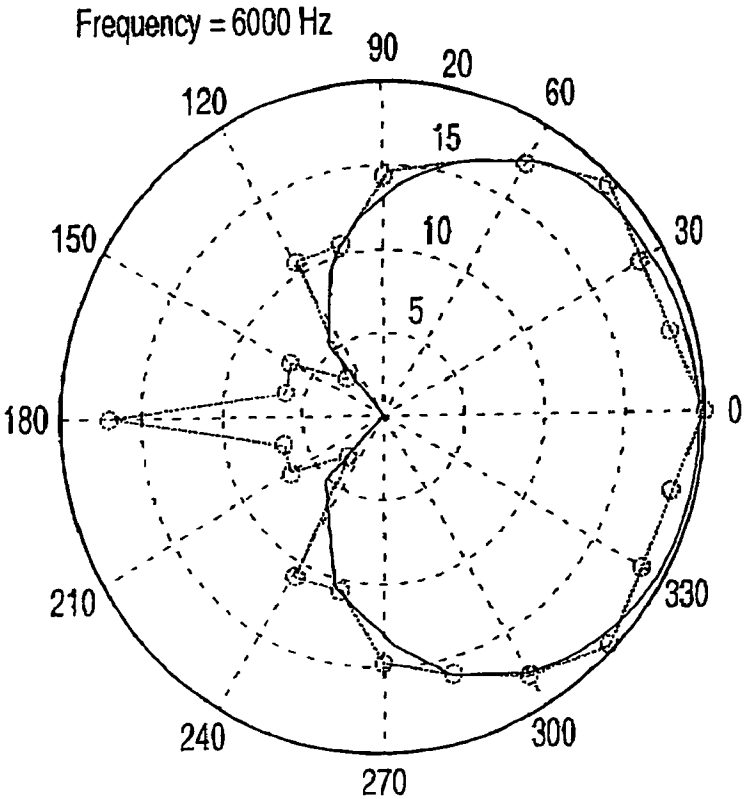

All of the possible sources at reasonably spaced (10 degrees in the preferred embodiment) intervals for $\theta$ and $\psi$ can then be computed. As a result of the reflecting plane, only the angles from 0 to 90 degrees are required for $\psi$. Using this data the beam pattern for a microphone in the object may be obtained. FIG. 7 illustrates these results, both from numerical simulation and actual measurements, in the plane of elevation of interest for the preferred embodiment. It will be noted from FIG. 7 that the results indicate a well-behaved cardioid that is reasonably constant with frequency. The measured results were taken with a B&K 4227 artificial mouth and are in good agreement with the numerical model, thereby justifying the monopole source simplification.

Next, the directivity can be further enhanced by the use of an absorptive material.

According to the invention, a layer of acoustic absorbent material (such as open cell foam or felt) is applied in a thin layer to the surface of the obstacle to absorb sound at high frequencies. Thus, the surface of the obstacle becomes a combination of perfectly reflecting rigid boundary (specific impedance $\beta=0$) and a boundary with a real specific impedance $0<\beta<1$, (i.e. pure absorbing conditions with no reactive impedance). The amount of absorption depends on the type of material used and on its dimensions and thickness. However, a layer of absorbent material having thickness of about $\lambda/4$ or higher is generally required to trap sound waves of wavelength $\lambda$.

In the preferred embodiment, a 5-mm thick layer of felt is used to provide an increase in absorption from 5 to 7 kHz, thereby increasing microphone directivity as compared with the hard plastic enclosure (rigid case).

Figure 8:
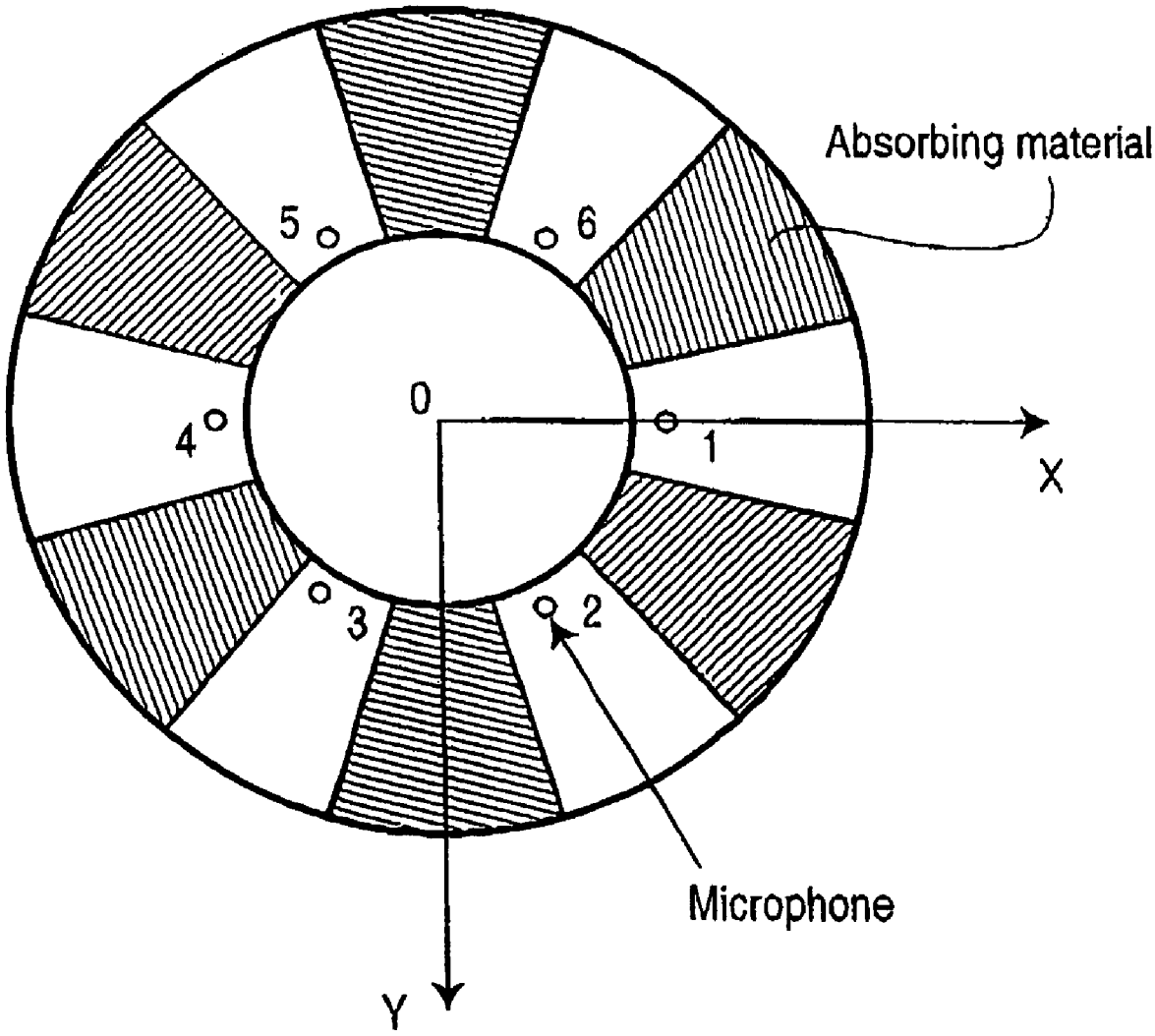
FIG. 8 shows placement of an acoustic absorbent material on a surface of the microphone array, according to the preferred embodiment.

The placement of the absorption material is important. In order to avoid attenuation at the microphones, the material must be separated from the microphones. Thus, as shown in FIG. 8, only the surface between the microphones is covered with material.

Figure 9:
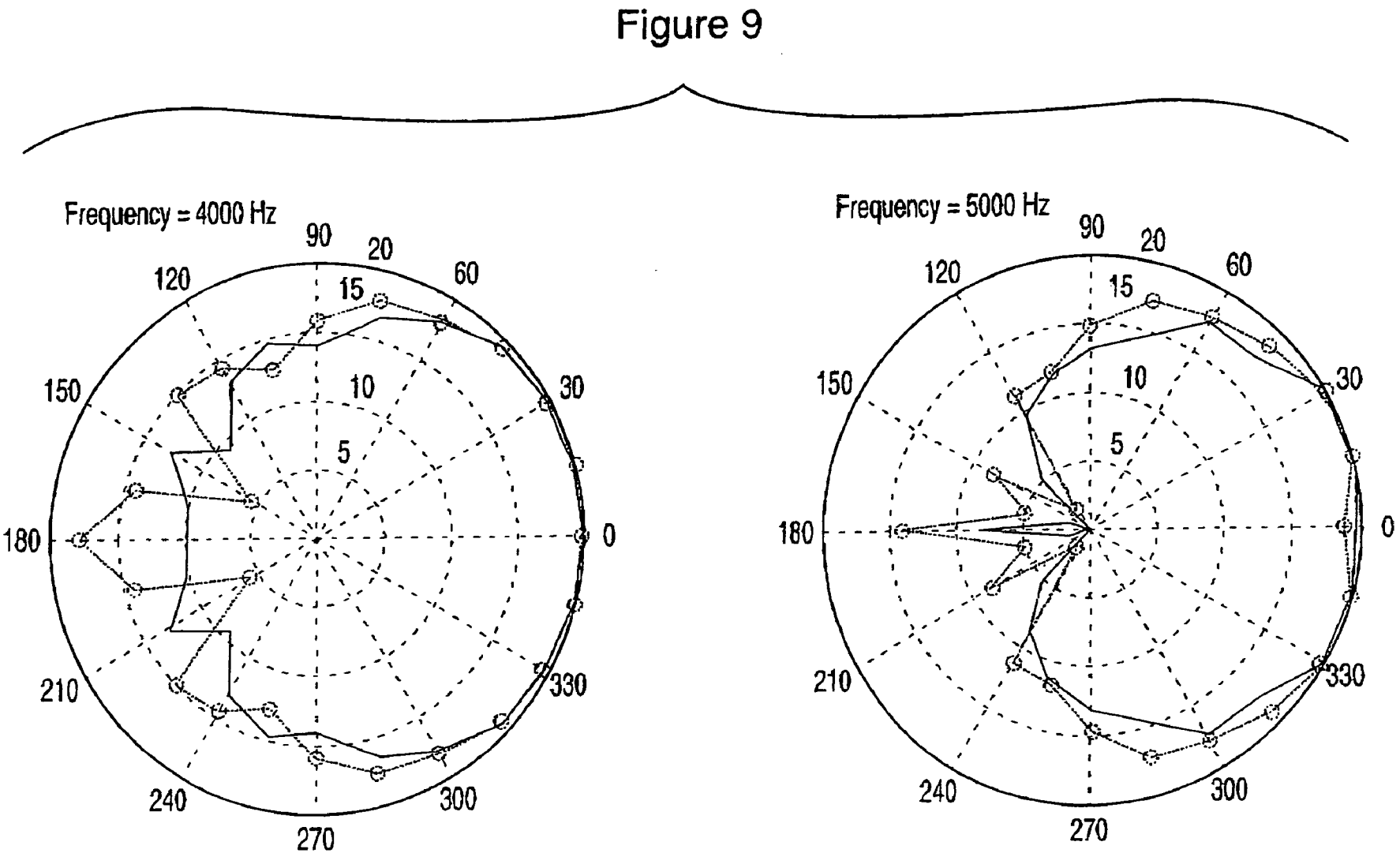
FIG. 9 is a plot showing an improvement in directivity for a single microphone resulting from the placement of acoustic absorbent material in FIG. 8.
Figure 9:
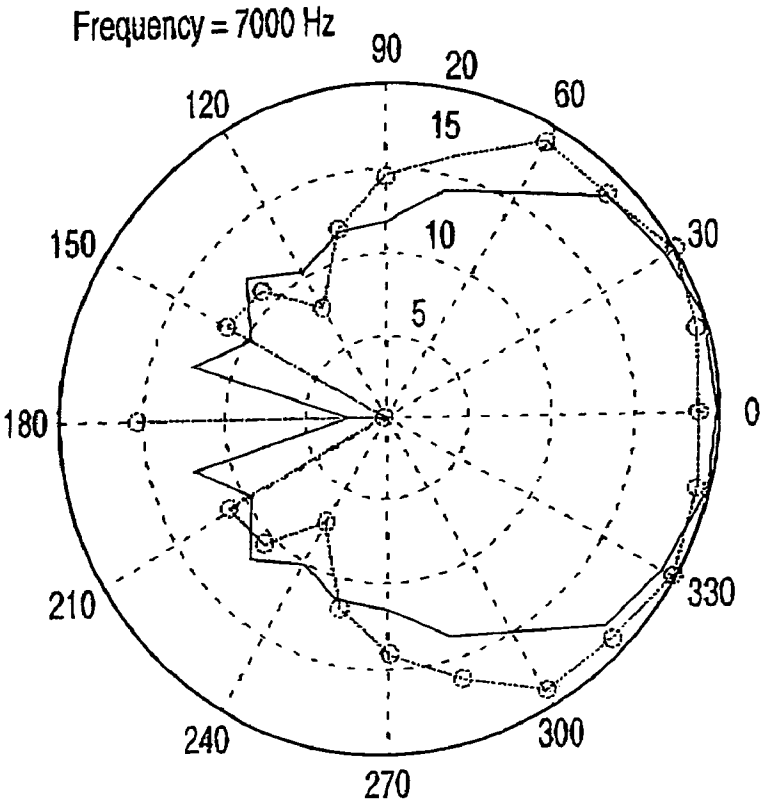
Figure 9:
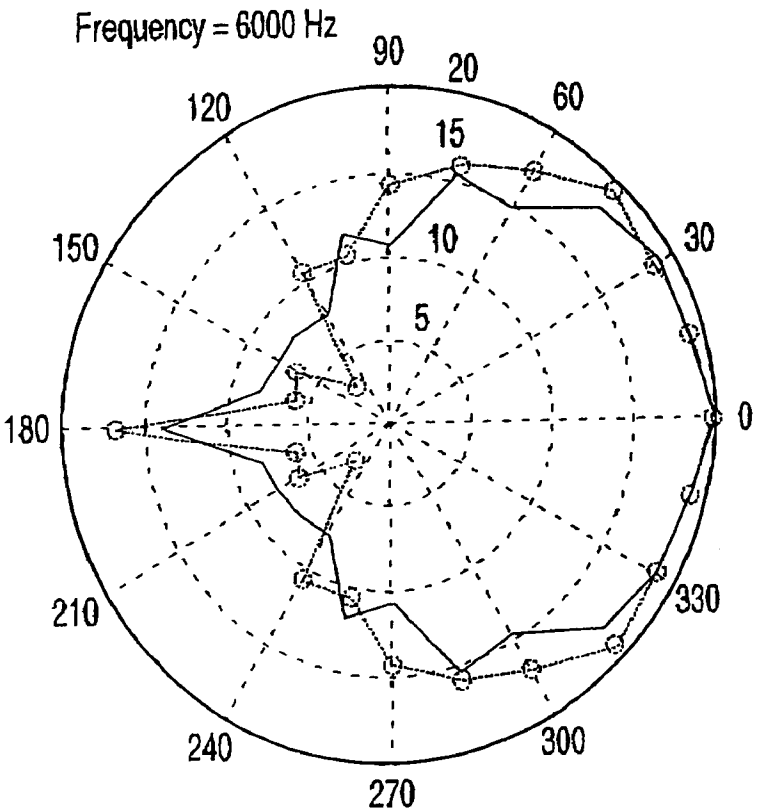

FIG. 9 shows the improvement in the measured microphone directivity with surface treatment as compared with a surface that has not been treated with acoustic absorption material. A significant narrowing of the beampattern is shown from 5 kHz.

The resulting directivity is satisfactory at 6 kHz and 7 kHz. Using a numerical method to calculate the sound fields and the BEM method as in [3], [5] and [7] and applying the superdirective approach, grating lobes will be observed as the $\lambda/2$ limit is approached (see the left-hand column of FIG. 10). In this particular case, after 4000 Hz the $w_{opt}$ degenerates to <1,0,0,0,0,0>. The results for such an abrupt transition are reasonably good but one can see a significant widening of the main lobe in the 4 kHz to 5 kHz region.

The grating lobes in these beams may be corrected as illustrated in the right hand column of FIG. 10, and the transition made less abrupt, by using linear constraints, as set forth in co-pending Patent Application Mitel 8061-734. Using two symmetrical look directions $d_{\theta-\alpha}$ and $d_{\theta+\alpha}$ with a gain constraint less than one (e.g. 0.707) results in a beam that is wider than the superdirective method but narrower than is provided by only using a diffracting object. The spacing of these two directions ($\theta-\alpha$ and $\theta+\alpha$) is controlled by $\alpha$ which increases with frequency. Eventually the frequency weights degenerate to $w_{opt}$=<1,0,0,0,0,0> for a six-element array at $\theta=0$. One skilled in the art of acoustics will be able to determine required variation in $\alpha$ with frequency, as it is dependent on the obstacle geometry.

A person skilled in the art may conceive of variations or modifications of the invention. For example, by choosing a more efficient or thicker absorbing material, the directivity at 4000 kHz can be further improved. All such variations and modifications are believed to be within the sphere and scope of the present invention.

A person skilled in the art will also recognise that the principles embodied herein can be applied to wave sensors that are not microphones (e.g. radio-frequency antennae, hydrophones, etc.). The diffracting structure would have to operate at the frequencies of interest (a choice of materials and size will be obvious to one skilled in the art) and this permits a spacing larger than $\lambda/2$ as the grating lobes are attenuated by the diffracting structure.

We claim:

1. A method of extending the frequency range of a microphone array embedded in a diffracting object beyond a microphone spacing limitation of $\lambda/2$, where A =acoustic wavelength, comprising:

configuring said diffracting object to obtain a desired high frequency directivity response at predetermined microphone positions on said diffracting object;

providing a low frequency beamformer operable at said predetermined microphone positions to achieve a desired low frequency directivity response; and applying linear constraints to said beamformer using two symmetrical look directions $d_{\theta-\alpha}$ and $d_{\theta+\alpha}$ with a gain constraint less than one and wherein the spacing $\theta-\alpha$ and $\theta+\alpha$ is controlled by $\alpha$ which increases with frequency, for providing a smooth transition between said low and high frequency directivity responses.

2. The method of claim 1, comprising applying a thin layer of acoustic absorbent material to the surface of said diffracting object to absorb sound at high frequencies.

3. The method of claim 2, wherein said acoustic absorbent material is applied between respective ones of said microphones.

4. The method of claim 3, wherein said acoustic absorbent material is applied to a thickness of about $\lambda/4$ or higher to trap sound waves of wavelength $\lambda$.

5. A conferencing unit, comprising:

an array of microphones embedded in a diffracting object configured to provide a desired high frequency directivity response at predetermined microphone positions on said diffracting object; and a low frequency beamformer operable at said predetermined microphone positions to achieve a desired low frequency directivity response, wherein said beamformer is linearly constrained using two symmetrical look directions $d_{\theta-\alpha}$ and $d_{\theta+\alpha}$ with a gain constraint less than one where the spacing $\theta+\alpha$ and $\theta+\alpha$ is controlled by $\alpha$ which increases with frequency.

6. The conferencing unit of claim 5, further including a thin layer of acoustic absorbent material applied to the surface of said diffracting object to absorb sound at high frequencies.

7. The conferencing unit of claim 6, wherein said acoustic absorbent material is applied between respective ones of said microphones.

8. The conferencing unit of claim 7, wherein said acoustic absorbent material is applied to a thickness of about $\lambda/4$ or higher to trap sound waves of wavelength $\lambda$.

9. The conferencing unit of claim 6 wherein said acoustic absorbent material is one of either open cell foam or felt.

10. The conferencing unit of claim 5, wherein said gain constraint is approximately 0.707.

11. A method of extending the frequency range of a wave sensor array embedded in a diffracting object beyond a inter sensor spacing limitation of $\lambda/2$, where $\lambda$=acoustic wavelength, comprising:

configuring said diffracting object to obtain a desired high frequency directivity response at predetermined sensor positions on said diffracting object;

providing a low frequency beamformer operable at said predetermined sensor positions to achieve a desired low frequency directivity response; and applying linear constraints to said beamformer using two symmetrical look directions $d_{\theta-\alpha}$ and $d_{\theta+\alpha}$ with a gain constraint less than one and wherein the spacing $\theta-\alpha$ and $\theta+\alpha$ is controlled by $\alpha$ which increases with frequency, for providing a smooth transition between said low and high frequency directivity responses.

* * * * *